United States Patent [19]

Metzger

[11] 4,331,527

[45] May 25, 1982

[54] ROTOGRAVURE CYLINDER PLATING APPARATUS

[75] Inventor: Hubert Metzger, Brookfield, Wis.

[73] Assignee: Printing Machinery & Electronics, Inc., Milwaukee, Wis.

[21] Appl. No.: 211,562

[22] Filed: Dec. 1, 1980

[51] Int. Cl.[3] ..... C25D 17/00; C25D 17/12

[52] U.S. Cl. ..... 204/212; 204/25; 204/272; 204/285

[58] Field of Search ..... 204/212, 285, 25, 272, 204/275

[56] References Cited

U.S. PATENT DOCUMENTS

| | | | |
|---|---|---|---|
| 1,381,882 | 6/1921 | Merritt | 204/212 |
| 1,792,998 | 2/1931 | Melish | 204/285 |

FOREIGN PATENT DOCUMENTS

| | | | |
|---|---|---|---|
| 2449735 | 4/1976 | Fed. Rep. of Germany | 204/212 |
| 715436 | 9/1954 | United Kingdom | 204/285 |
| 442236 | 9/1974 | U.S.S.R. | 204/13 |

*Primary Examiner*—T. Tufariello

*Attorney, Agent, or Firm*—Littlepage & Webner

[57] ABSTRACT

Polypropylene plastic baskets for phosphor copper anode nuggets are suspended, one on each side of a cylinder to be plated, in a bath of plating electrolyte. The tops of the baskets are disposed beneath the surface of the plating solution, the upper portion of the cylinder is above the surface of the electrolyte, and lead anode conductor strips extend downwardly along the insides of the rear walls of the baskets.

4 Claims, 2 Drawing Figures

ROTOGRAVURE CYLINDER PLATING APPARATUS

FIELD OF INVENTION

Chemistry, electrical and wave energy, processes and products, coating, cylinders, rolls or hollow articles.

OBJECTS

In electroplating rotogravure cylinders, it is customary to rotate the cylinder, as a cathode, in a bath of electrolyte in which copper nuggets are supported in curved baskets disposed one on each side of the cylinder. Heretofore, the anode baskets typically were of titanium, which greatly limited the current-carrying capacity, and at spot contacts the titanium burned out. The object of this invention is to provide concavo-convex baskets for the copper nuggets which are made of plastic, i.e, polypropylene, supported by non-current-carrying, protectively-coated hangers in the electrolyte bath. The concave or front walls of the baskets which face the cylinder are perforate, and curved lead anodes extend downwardly along the inner sides of the rear walls of the baskets and contact the copper nuggets. The copper nuggets, since they surround three sides of the lead anodes and are disposed between the lead anodes and th cylinder thus protect the lead anodes against wear-out; and the baskets, being of nonconductive plastic material, are not subject to burn out at "hot spots".

A further object is to provide a cylinder-plating apparatus of the type described, in which the top of the rotating cylinder to be plated is disposed above the surface of the electrolyte so that a washing action occurs as the surface of the cylinder sweeps across the surface of the electrolyte; in which the tops of the baskets are disposed below the surface of the electrolyte so as to ensure free circulation of constantly-refreshed electrolyte; and in which the electrolyte is injected via a manifold into the bath at a location along the bottom of one basket which is less than 180° from the top of the cylinder, as measured in the direction of the cylinder rotation, the injection being in the direction of cylinder rotation. By this means, the electrolyte is entrained and carried along with the cylinder between the cylinder and the basket thence against the top of the cylinder and over the baskets.

Figure 1:
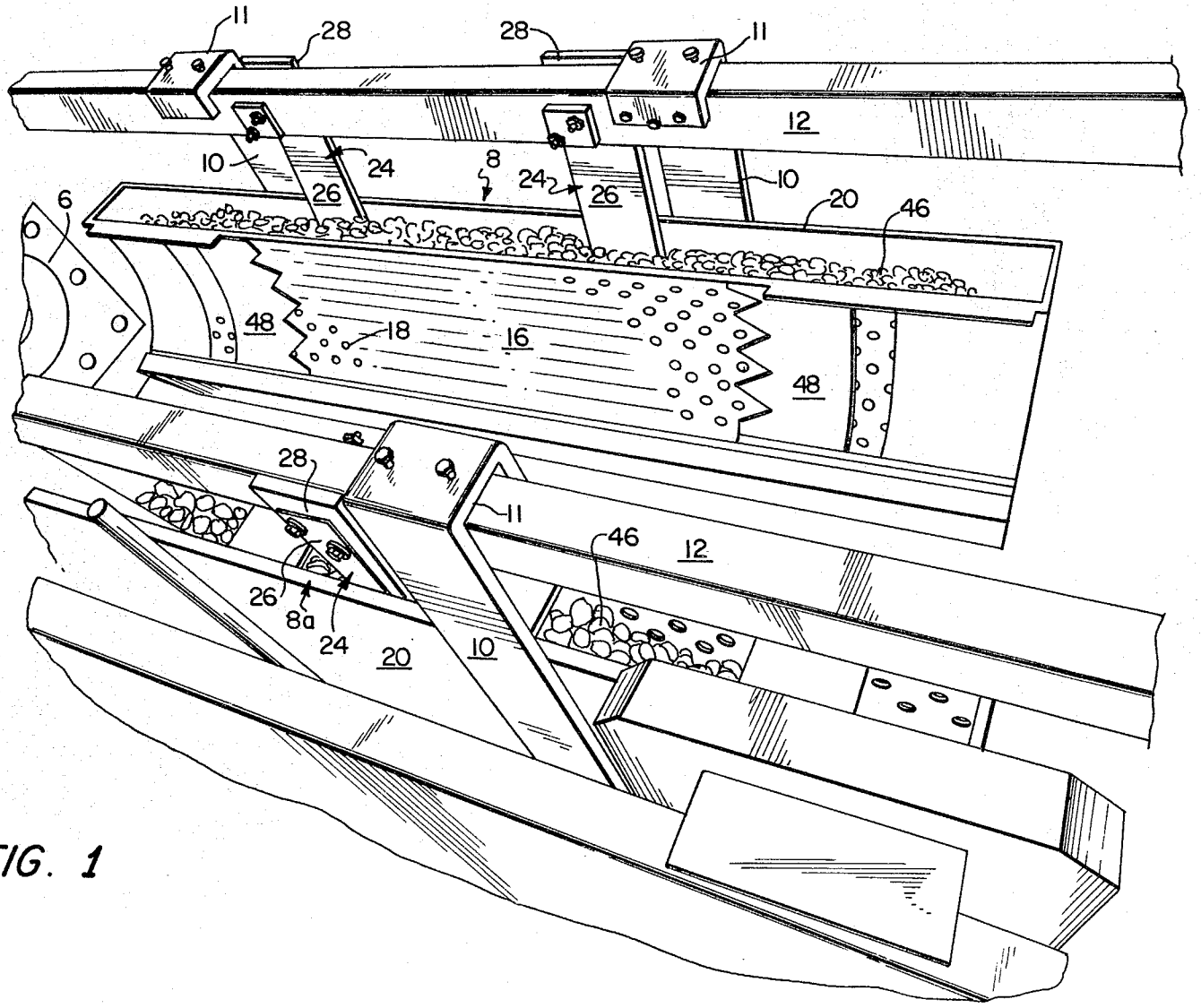
Figure 2:
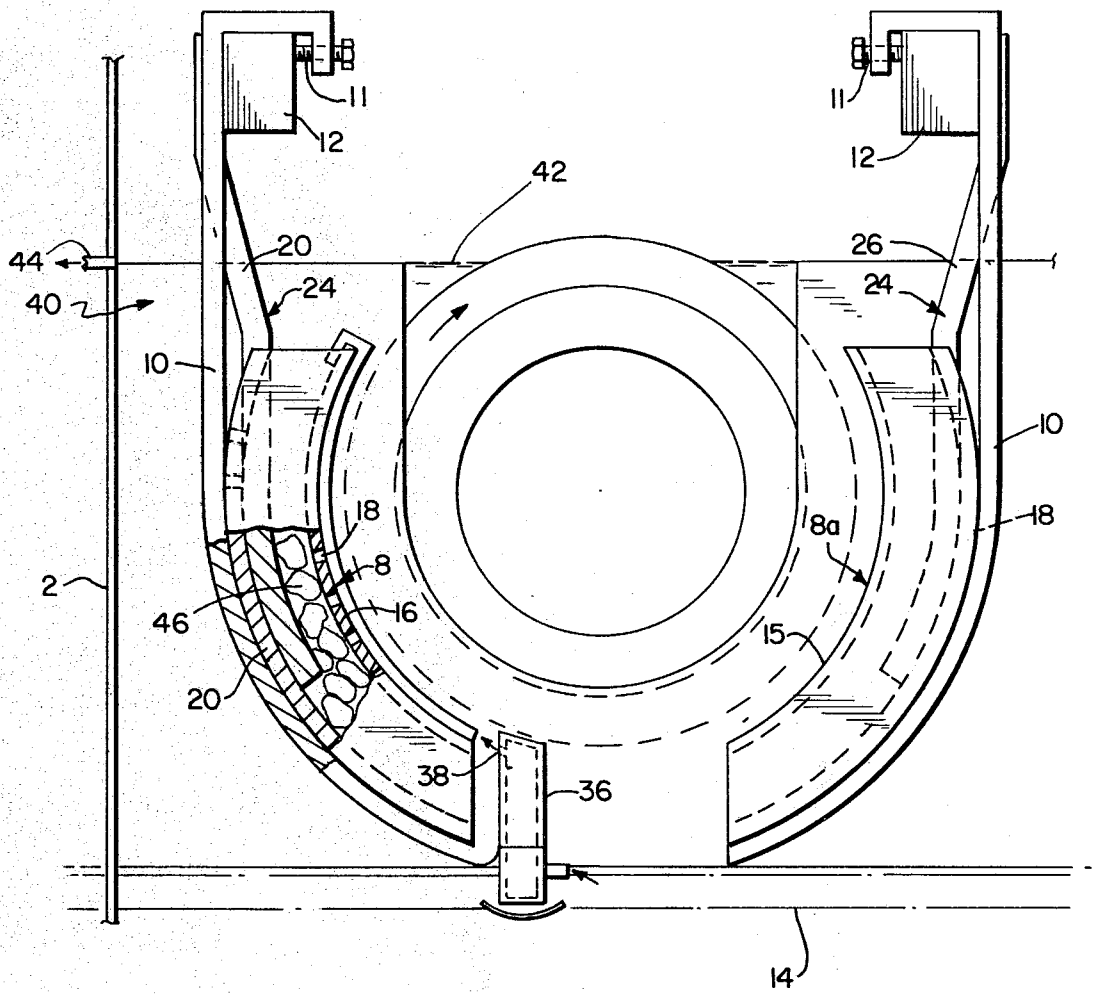

These and other objects will be apparent from the following specifications and drawings, in which FIG. 1 is a fragmentary perspective view of the baskets, with the cylinder removed; and FIG. 2 is an end elevation, partly broken away showing the baskets and their mountings.

Referring now to the drawings in which like reference numerals denote similar elements, the plating apparatus includes a tank having an end wall 2. A cylinder 4 to be plated is rotatably supported at its ends by bearings 6, in which it is rotatably driven by a suitable power device, not shown. Since the tank and cylinder mounting and drive are conventional, they are not detailed. On each side of the cylinder are disposed concavo-convex baskets 8 and 8*a* of polypropylene whose concave walls are disposed towards the cylinder. The baskets are suspended by hanger bars 10 attached as at 11 to anode current-carrying rails 12. The ends of the anode rails are conventionally supported by the tank ends. The inner walls 16 of the baskets have perforations 18 and the outer sides 20 of the baskets are blind, except for two rows of holes near their tops which permit plating solution to flow through. Suspended within the baskets and against the inner sides of outer walls are lead anodes 24 which consist of curved flat strips 26 attached as a 28 to the anode rail. The upper portions of the lead anode strips 26 are coated to protect them from the electrolyte and the lower portions are bare and in intimate contact with the copper nuggets 34. Mounted along the lower inner wall of basket 8 is a manifold 36, which is less than 180° away from the top of the cylinder and which is provided with jet outlets 38 which inject electrolyte 40 between the basket and cylinder and in the direction of basket rotation. Electrolyte 40 consisting of 220–250 g/liter copper sulphate and 60 g/liter sulfuric acid fills the tank to a level 42. The level 42 is maintained, as by an overflow return 44. High phosphor copper mini-nuggets 46, preferably 0.04 to 0.06 percent phosphor, are used. Plastic shield plates 48 are used when cylinders of shorter length are plated so as to prevent over-plating at the cylinder ends.

In operation, the packing of the copper nuggets around the lead anode strips and between the lead anode strips and the cylinder being plated protects the lead anode strips against wear-out. To ensure complete and constant exchange of the electrolyte, the tops of the baskets must always be below the top of the cylinder: otherwise the baskets dam up the electrolyte and cause it to stagnate between the baskets and the cylinder and to over-heat. The top of the cylinder should be above the level of the electrolyte so as to produce a washing action as the surface of the cylinder leaves and enters the electrolyte. Without these precautions the cylinder plating is rough.

I claim:

1. Apparatus for electrolytic plating of rotogravure cylinders, comprising a tank adapted to contain a plating solution and including means for supporting therein a cylinder for rotation about a horizontal axis in one direction baskets disposed in said tank, one on each side of the cylinder, with inner concavo-convex arcuate perforate walls closely spaced from and concentric with the cylinder and outer concavo-convex arcuate walls concentric with and spaced from the inner walls in the direction away form the cylinder, said baskets being of non-conducting plastic material, elongate metalic anode strips having upper protectively coated portions disposed above the baskets, and lower bare portions extending downwardly along inner sides of the outer basket walls, said lower portion being arcuate and concentric with the cylinder, means for supplying anode current to the upper portions of the anode strips, nuggets of metal to be plated onto the cylinder, said nuggets being packed in said baskets between the lower portions of said anode strips and the front walls of the baskets, said baskets having tops disposed below the top of the cylinder, and supply and return means for maintaining plating solution in the tank with the level thereof below the top of the cylinder and above the tops of the baskets.

2. Apparatus as claimed in claim 1, the supply means for the plating solution including a manifold disposed along a lower portion of the inner wall of one of the baskets and having jet outlets for injecting jets of plating solution into the space between the inner side of said inner wall and the surface of said cylinder.

3. A basket assembly for electroplating copper cylinders, comprising;

a basket adapted to be packed with nuggets of copper metal to be plated onto a cylinder and being formed of non-conductive polypropyleneplastic and comprised of spaced concavo-convex front and rear walls, the front wall being perforate, said basket being adapted to be suspended in a plating solution with the concave side of the front wall disposed towards the cylinder to be plated, a plurality of elongate lead anode bars having upper protectively coated portions extending upwardly from said basket and lower bare portions extending downwardly in said basket along the inner side of the rear wall thereof and being spaced from the inner side of the front wall thereof, and means for connecting the upper portions of said anode bars to an anode current supply, said basket walls and the lower bare portions of said anode bars being curved along arcs of concentric circles.

4. A basket assembly as claimed in claim 3, said anode bars being substantially flat and the lower portions thereof being curved in complement to the concave side of the basket rear wall and with flat sides of the bars engaging against said concave side of said rear basket wall.

* * * * *

UNITED STATES PATENT AND TRADEMARK OFFICE

CERTIFICATE OF CORRECTION

PATENT NO. : 4,331,527

DATED : May 25, 1982

INVENTOR(S) : Hubert Metzger

It is certified that error appears in the above—identified patent and that said Letters Patent is hereby corrected as shown below:

In column 1, line 27, correct "th",
to -- the --.

In column 2, line 5, correct "a", to -- at --.

In Claim 1, line 46, delete "form",
insert -- from --.

line 49, correct "metalic"
to "metallic"

Signed and Sealed this

*Tenth* Day of *August 1982*

[SEAL]

*Attest:*

GERALD J. MOSSINGHOFF

*Attesting Officer*

*Commissioner of Patents and Trademarks*